United States Patent [19]

Endo et al.

[11] 4,455,989

[45] Jun. 26, 1984

[54] PLASMA IGNITION SYSTEM FOR INTERNAL COMBUSTION ENGINE

[75] Inventors: Hiroshi Endo; Masazumi Sone; Iwao Imai; Yasuki Ishikawa, all of Yokosuka, Japan

[73] Assignee: Nissan Motor Company, Limited, Kanagawa, Japan

[21] Appl. No.: 388,703

[22] Filed: Jun. 15, 1982

[30] Foreign Application Priority Data

Jun. 16, 1981 [JP] Japan ..... 56-92478

[51] Int. Cl.[3] ..... F02P 3/08

[52] U.S. Cl. ..... 123/620; 123/605; 123/626; 123/643

[58] Field of Search ..... 123/620, 643, 605, 596, 123/598, 625, 626, 143 B

[56] References Cited

U.S. PATENT DOCUMENTS

| | | | |
|---|---|---|---|
| 4,223,656 | 9/1980 | Hamley | 123/620 |
| 4,366,801 | 1/1983 | Endo et al. | 123/620 |
| 4,369,756 | 1/1983 | Ezoe | 123/620 |
| 4,369,758 | 1/1983 | Endo | 123/620 |
| 4,407,259 | 10/1983 | Abo | 123/620 |

FOREIGN PATENT DOCUMENTS

| | | |
|---|---|---|
| 2085076 | 4/1982 | United Kingdom . |
| 2085523 | 4/1982 | United Kingdom . |

*Primary Examiner*—Andrew M. Dolinar

*Attorney, Agent, or Firm*—Lowe, King, Price & Becker

[57] ABSTRACT

A plasma ignition system for an internal combustion engine which varies a discharge time of a plasma ignition energy charged capacitor according to the engine operating condition, e.g., the current engine speed. The plasma ignition system comprises: (a) a plurality of plasma ignition plugs, each provided within the corresponding engine cylinder; (b) a DC-DC converter which produces and outputs a high DC voltage; (c) a plurality of first capacitors each for charging and discharging the high DC voltage from the DC-DC converter; (d) a plurality of switching circuits each connected to the corresponding first capacitor for defining the discharge time interval of the corresponding first capacitor in response to a trigger signal inputted thereto at a predetermined ignition timing; (e) a trigger signal generator which generates and outputs the trigger signal to each corresponding switching circuit, the width of the trigger signal being varied so as to become narrower when the engine rotates at a speed higher than a predetermined value; and (f) a plurality of transformers each connected to the corresponding capacitor which receives the high DC voltage from the corresponding first capacitor through the corresponding switching circuit at the primary winding thereof and boosts the high oscillation voltage generated at the primary winding thereof according to the winding ratio between the secondary and primary windings thereof so as to apply the boosted voltage to the corresponding plasma ignition plug.

11 Claims, 12 Drawing Figures

PLASMA IGNITION SYSTEM FOR INTERNAL COMBUSTION ENGINE

REFERENCE TO RELATED APPLICATIONS

This application is related to copending applications Ser. No. 403,360, filed July 30, 1982, now U.S. Pat. No. 4,441,479; Ser. No. 386,781, filed June 7, 1982, now U.S. Pat. No. 4,433,669; Ser. No. 428,229, filed Sept. 29, 1982, and Ser. No. 444,615, filed Nov. 26, 1982.

BACKGROUND OF THE INVENTION

Field of the Invention

The present invention relates generally to a plasma ignition system for an internal combustion engine and more specifically to a plasma ignition system for an internal combustion engine having a plurality of engine cylinders within each of which a plasma ignition plug is mounted, which performs plasma ignition without failure of ignition and improves a stable combustion even under an engine operating condition where a combustion of fuel supplied to the engine becomes unstable, e.g., in a region of engine low load condition and in a combustion of lean air-fuel mixture.

SUMMARY OF THE INVENTION

It is an object of the present invention to provide a plasma ignition system for an internal combustion engine having a plurality of cylinders, wherein the engine operating condition is judged on a basis of the present engine speed and an amount of high plasma ignition energy charged within a capacitor for charging a plasma ignition energy to be discharged into each corresponding plasma ignition plug is varied according to the judged engine condition so as to supply a least possible amount of ignition energy into each corresponding plasma ignition plug, consequently the consumption of electric current flowing through the corresponding plasma ignition plug, i.e., power can be reduced chiefly in a region where the engine rotates at a high speed.

BRIEF DESCRIPTION OF THE DRAWINGS

The features and advantages of the present invention will be appreciated from the following description in conjunction with the accompanied drawings in which like reference numerals designate corresponding elements and in which.

DETAILED DESCRIPTION OF THE PREFERRED EMBODIMENTS

Reference will be made hereinafter to the attached drawings and first to FIG. 1 which shows an example of a plasma ignition plug to be mounted within each engine cylinder of the engine.

Figure 1A:
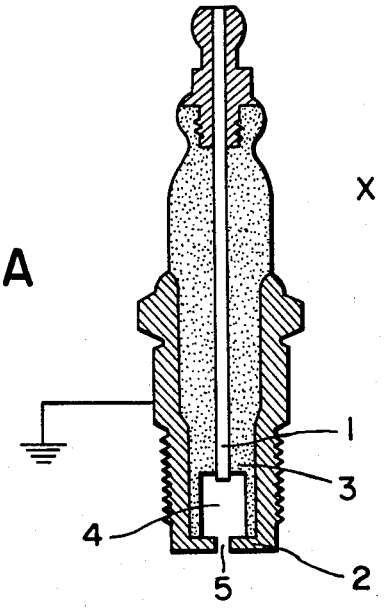
FIG. 1 shows sectional and bottom views of an example of a plasma ignition plug used in a plasma ignition system according to the present invention.
Figure 1B:
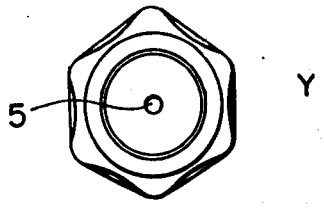

In FIG. 1, numeral 1 denotes a central electrode located at a center of the plasma ignition plug, numeral 2 denotes a side electrode located at substantially lower end thereof so as to enclose the central electrode 1, and numeral 3 denotes an electrical insulating member, e.g., made of ceramics located between the central and side electrodes 1 and 2. The side electrode 2 is grounded. A discharge gap 4 of small volume is formed between the lower top end of the central electrode 1 and bottom end of the side electrode 2. The plasma ignition plug of such a construction described above generates a plasma discharge phenomenon at the discharge gap 4 between the central and side electrodes 1 and 2 in response to a high voltage impulse applied thereacross to be described hereinbelow so that at first a spark discharge occurs, generates secondly arc discharge at the discharge gap 4 where electric breakdown already occurs due to the spark discharge, and injects plasma high-temperature gas generated within the discharge gap 4 into the corresponding engine cylinder (combustion chamber) through a hole 5 provided at a center of the bottom end of side electrode 2. Consequently, airmixture fuel is ignited and combusted completely by the plasma high-temperature gas.

Figure 2A:
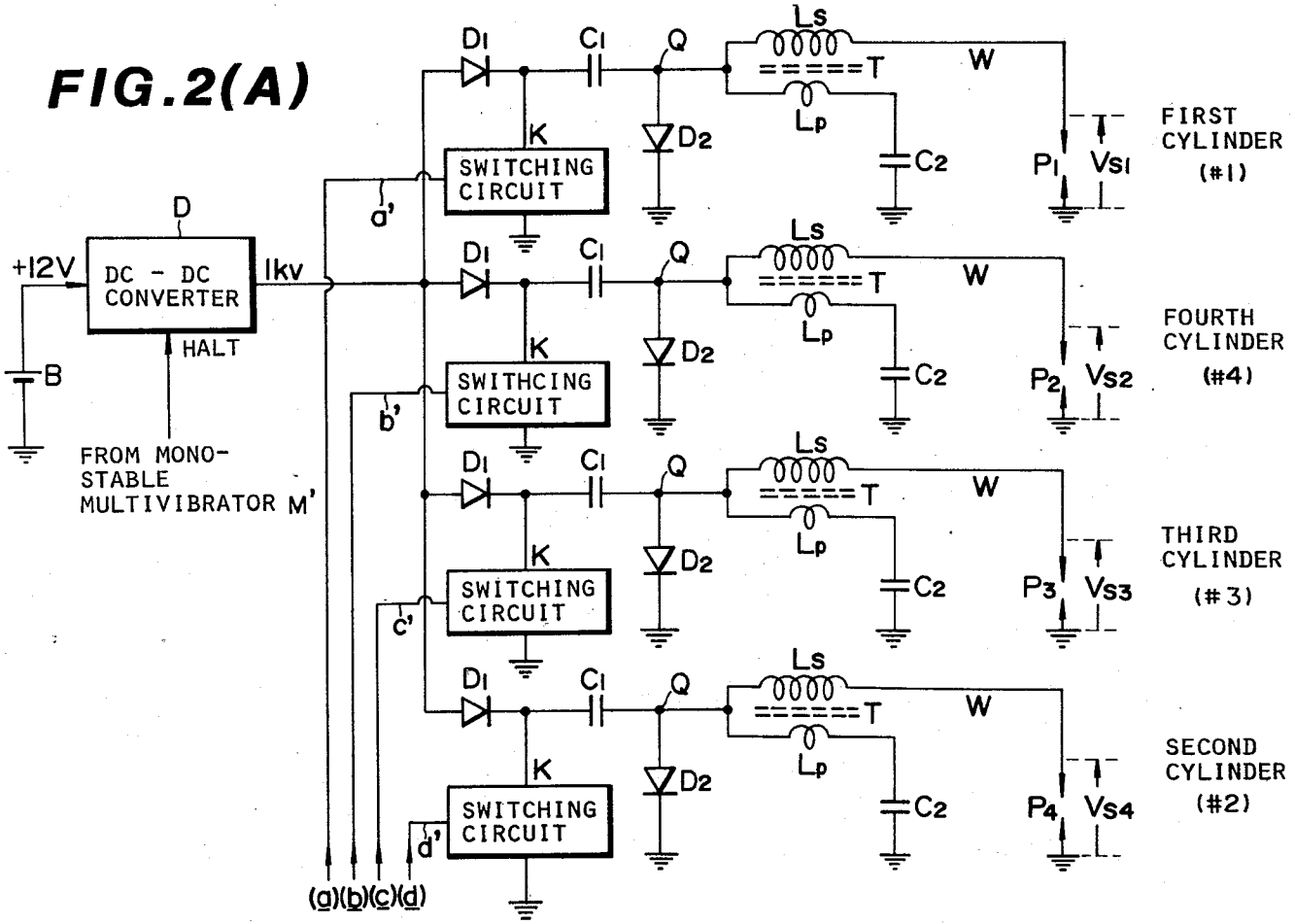
FIGS. 2(A) and 2(B) are an overall circuit diagram in combination with each other showing a preferred embodiment of a plasma ignition system used for a four-cylinder internal combustion engine according to the present invention.
Figure 2B:
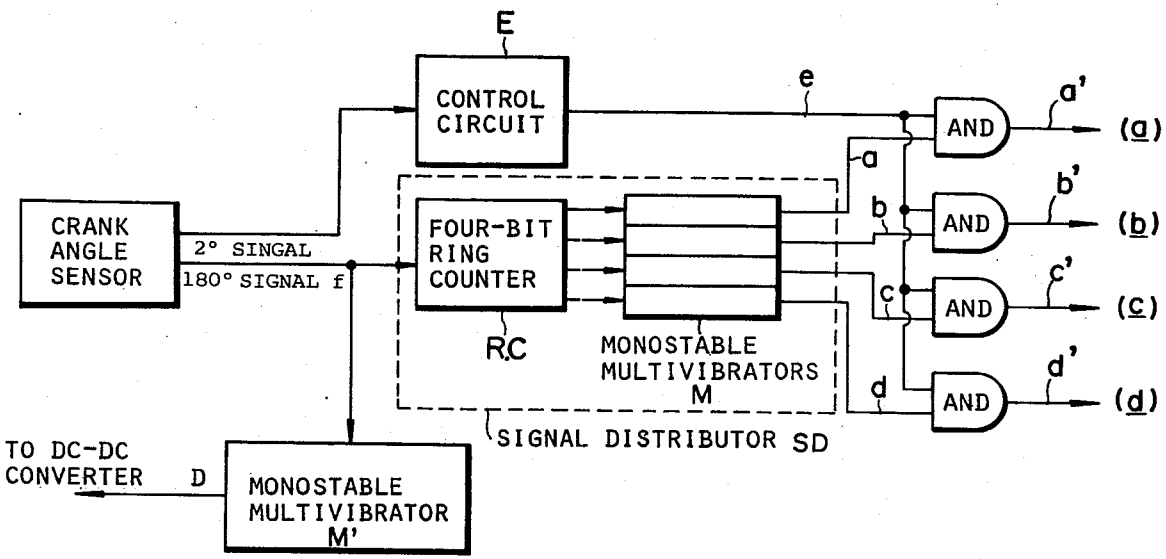

FIGS. 2(A) and 2(B) show a preferred embodiment of a plasma ignition system according to the present invention wherein each corresponding plasma ignition plug $P_1$ through $P_4$ shown in FIG. 1 is properly arranged within each cylinder numbered first, fourth, third, and second. It will be seen that the plasma ignition system shown in FIGS. 2(A) and 2(B) is used in a four-cylinder engine.

In FIG. 2, symbol D denotes a DC-DC converter which inverts a low DC voltage, e.g., +12 V supplied from a DC voltage power supply such as a battery B into corresponding AC voltage by the oscillation action and thereafter converts the AC voltage into a high DC voltage, e.g., 1000 volts. The construction of the DC-DC conveter D is well known in those skilled in the art. Therefore, the explanation of the construction of the DC-DC converter D is omitted hereinafter. The output terminal of the DC-DC converter D is connected to a first capacitor $C_1$ provided for each cylinder via a first diode $D_1$ such that the anode terminal of each first diode $D_1$ is connected to the output terminal of the DC-DC converter D and the cathode terminal thereof is connected to one terminal of each first capacitor $C_1$. It will be seen that the other terminal of each capacitor $C_1$ is connected to the anode terminal of a second diode $D_2$ whose cathode terminal is grounded. In addition, the cathode terminal of each first diode $D_1$ is also connected to one terminal K of a switching circuit. It will also be seen that the other terminal of the switching circuit is grounded. The other terminal of each first capacitor $C_1$ is connected to a common terminal of a corresponding voltage boosting transformer T as denoted by Q. The other terminal of a primary winding $L_p$ of each transformer T is grounded through a corresponding second capacitor $C_2$. The other terminal of a secondary winding $L_s$ of each transformer T is connected to the central electrode 1 of the corresponding plasma ignition plug $P_1$ through $P_4$. It is already understood that the side electrode 2 of each plasma ignition plug $P_1$ through $P_4$ is grounded. The winding ratio of each transformer T between the primary winding $L_p$ and secondary winding $L_s$ is 1:N.

Furthermore, it should be noted that drive terminal of each switching circuit is connected to an output terminal of each AND gate circuit AND shown in FIG. 2(B). One of two input terminals of each AND gate circuit AND is connected to an output terminal of a control circuit E. The control circuit E is connected to a crank angle sensor. The crank angle sensor outputs a pulse signal having a period corresponding to a crankshaft rotation of 2° when the engine rotates. Therefore, the control circuit E receives the pulse signal having a width corresponding to 1° rotation of the engine from the crank angle sensor and determines the engine speed on a basis of the number of the pulse signal described above per time and outputs another pulse signal, the width of the latter pulse signal being varied according to the determined engine speed. The crank angle sensor also outputs another ignition pulse signal f in synchronization with the 2° signal described above whenever the crankshaft rotates 180° (half) in the case of the four-cylinder engine. The period of the pulse signal f depends on the number of engine cylinders. For example, the period of the pulse signal f corresponds to 120° of the crankshaft rotation in the case of a six-cylinder engine. It is well known that the crankshaft makes two rotations per engine cycle (720°). The ignition pulse signal f is fed into an ignition pulse signal distributor SD wherein each original trigger pulse signal a, b, c, and d for originally triggering each corresponding switching circuit according to a predetermined ignition order to ground the one terminal of each corresponding first capacitor $C_1$ is produced.

In the control circuit E, the rising edge of output pulse signal e is in agreement in time with that of each original trigger pulse signal a, b, c, and d and the pulse width of the output pulse e becomes narrower as the engine speed increases. If each original trigger pulse signal a, b, c, and d is ANDed with the output pulse signal e of the control circuit E by means of each AND gate circuit AND, the ANDed pulse signal from each AND gate circuit AND takes a form of a trigger pulse signal a', b', c', and d' to be sent to each corresponding switching circuit shown in FIG. 2(A) so that pulsewidth is varied depending on that of the output pulse signal e of the control circuit E. Therefore, the grounding time interval of each switching circuit for each corresponding first capacitor $C_1$ is controlled according to the pulsewidth of the output pulse signal e from the control circuit E.

Figure 8:
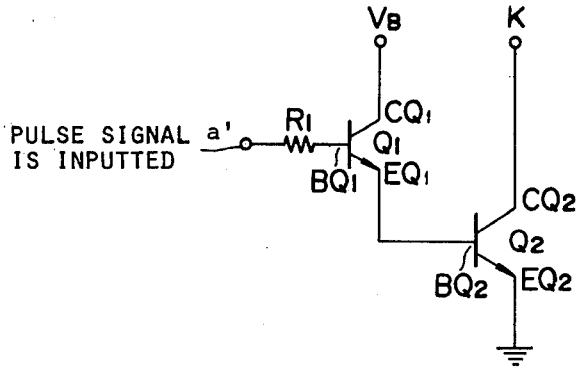
FIG. 8 shows an example of each switching circuit shown in FIG. 2(A) using a high power transistor in darlington connection.
Figure 9:
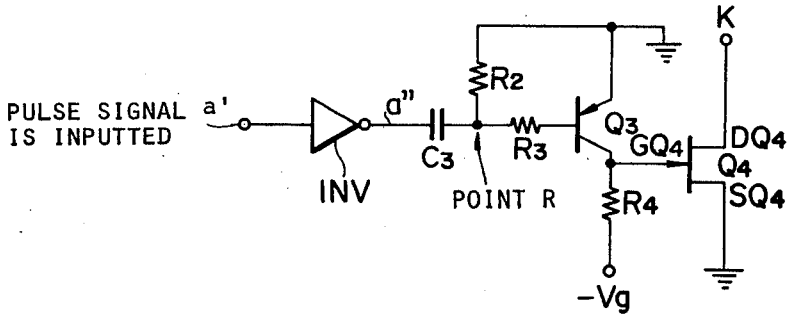
FIG. 9 shows another example of each switching circuit shown in FIG. 2(A) using a N-channel high power FET (Field Effect Transistor)
Figure 10:
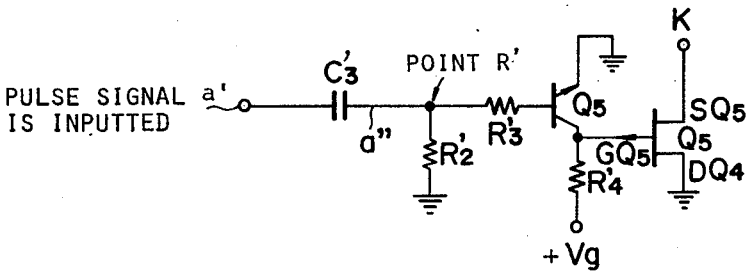
FIG. 10 shows still another example of each switching circuit shown in FIG. 2(A) using a P-channel high power FET.

FIGS. 8, 9, and 10 show examples of the switching circuits shown in FIG. 2(A).

Each switching circuit uses a high power transistor $Q_2$, as shown in FIG. 8. As shown in FIG. 8, a collector $CQ_2$ of the high power transistor $Q_2$ is connected to the one terminal K of the corresponding first capacitor $C_1$ and to the cathode terminal of the corresponding first diode $D_1$ and an emitter thereof is grounded. A base $BQ_2$ of the high power transistor $Q_2$ is connected to an emitter $EQ_1$ of an auxiliary transistor $Q_1$. A collector $CQ_1$ of the auxiliary transistor $Q_2$ is connected to, e.g., the plus line from the battery B shown in FIG. 2(A). B base $BQ_1$ of the auxiliary transistor $Q_1$ is connected to the corresponding AND gate circuit $AND_1$ via a first resistor $R_1$. When, e.g., the ANDed trigger pulse signal a' is inputted into the auxiliary transistor $Q_1$ at the high voltage level, the transistor $Q_1$ turns on (in saturation) and the voltage supplied from the battery B is applied to the base of the high power transistor $Q_2$. Thus the high power transistor $Q_2$ conducts so as to render the point K connected to the one terminal of the corresponding capacitor $C_1$ shown in FIG. 2(A) in the ground level. Conversely, when the ANDed trigger pulse signal a' is at a low voltage level, e.g., zero voltage, the auxiliary transistor $Q_1$ is turned off and accordingly the high power transistor $Q_2$ is turned off. Consequently, the point K becomes inconductive with respect to the ground.

Alternatively, each switching circuit may use a high power N channel-type FET $Q_4$ (Field Effect Transistor) as shown in FIG. 9.

In this example, a drain $DQ_4$ of the high power FET $Q_4$ is connected to the other terminal of the corresponding first capacitor $C_1$ shown in FIG. 2(A) as denoted by K and a source $SQ_4$ thereof is grounded. A gate $GQ_4$ of the high power FET $Q_4$ is connected to the collector of another auxiliary transistor $Q_3$ and to a minus DC voltage supply $-V_g$ via a fourth resistor $R_4$. The emitter of the auxiliary transistor $Q_3$ is grounded and the base thereof is connected to one terminal of a third capacitor $C_3$ via a third resistor $R_3$. The one terminal of the third capacitor $C_3$ is also grounded via a second resistor $R_2$ to form a differentiator. The other terminal of the third capacitor $C_3$ is connected to an output terminal of an inverter INV. The input terminal of the inverter INV is then connected to the corresponding AND gate circuit AND shown in FIG. 2(B).

In this example, when the ANDed trigger pulse signal a' is inputted into the inverter INV at the high voltage level, the inverter INV inverts the level into the low voltage level a'', e.g., zero volt. The inverted low-voltage signal a'' is then supplied to a point R via the third capacitor $C_3$. Therefore, a negative going pulse below zero volt is produced on the rising edge of the ANDed trigger pulse signal a'. Simultaneously when the negative going pulse is produced by the third capacitor $C_3$ at the point R, the auxiliary transistor $Q_3$ turns on and the gate terminal of the high power FET $Q_4$ indicates substantially zero voltage (connected to the ground) so that the high power FET $Q_4$ turns on to ground the point K via the channel between the drain and source thereof $DQ_4$ and $SQ_4$. It should be noted that the gate $GQ_4$ of the high power FET $Q_4$ is at a minus voltage level below a pinch-off voltage $V_{poff}$ of the type of the high power FET $Q_4$ shown in this drawing ($V_{poff}$ indicates generally minus 50 volts in this type shown in FIG. 9) when the auxiliary transistor $Q_3$ is inconductive.

FIG. 10 shows each switching circuit using a high-power P-channel FET for grounding each corresponding first capacitor $C_1$ in the way as shown by FIGS. 8 and 9.

Figure 3:
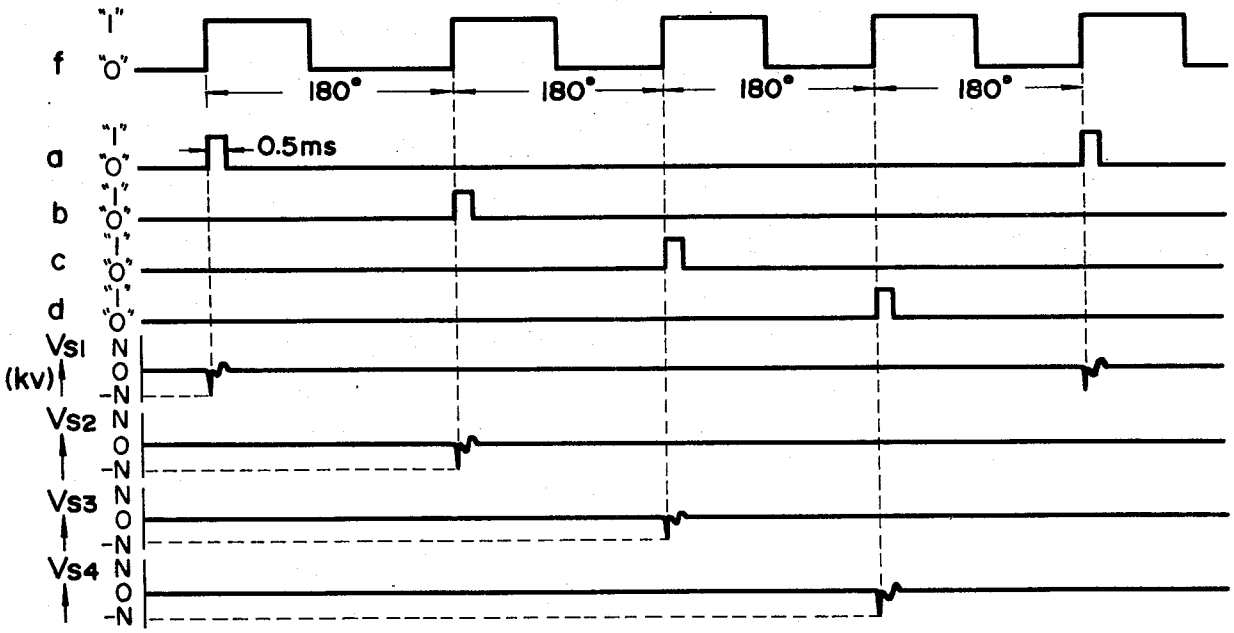
FIG. 3 shows a signal timing chart of a representative circuit block constituting the plasma ignition system shown in FIGS. 2(A) and 2(B) or in FIGS. 2(A) and 2(C)

The ignition pulse signal distributor SD shown in FIG. 2(B) comprises, e.g., a four-bit ring counter R.C which produces circularly a pulse having a width corresponding to the 180° of engine crankshaft rotation at each of four output terminals thereof according to a predetermined ignition order of the engine cylinders and a group of monostable multivibrators M each connected to the corresponding output terminal of the four-bit ring counter R.C which outputs one original trigger pulse signal a having a constant pulsewidth, e.g., 0.5 miliseconds as shown in FIG. 3 whenever the pulse signal having a pulse width equal to the 180° rotation of the engine in the case of the four-cylinder engine is received from the four-bit ring counter R.C. In the case of, e.g., six-cylinder engine, the ring counter R.C is a six-bit ring counter. The bit number of the ring counter depends on the number of engine cylinders. The output terminal of each monostable multivibrator M within the signal distributor SD is connected to one input terminal of each AND gate circuit AND as shown in FIG. 2(B).

Figure 4:
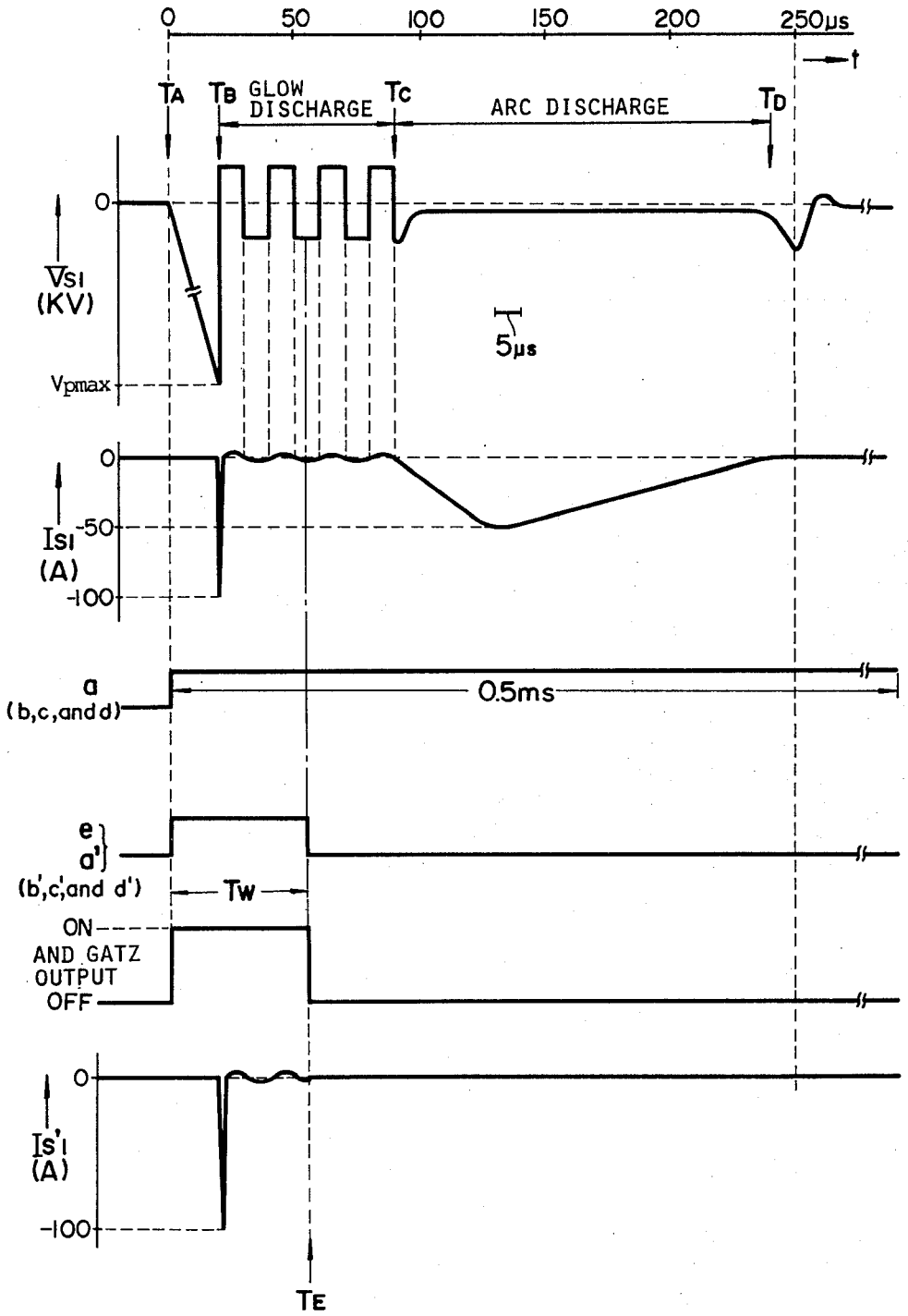
FIG. 4 shows a detailed signal waveform timing chart of each circuit block shown in FIGS. 2(A) and 2(B), particularly signal waveforms applied across one of the plasma ignition plugs shown in FIG. 2(A)

When one of the ANDed trigger pulse signals a', b', c', and d' is supplied into the corresponding switching circuit from each AND gate circuit AND, with the high DC voltage from the DC-DC converter D charged within the corresponding first capacitor $C_1$ via the first diode $D_1$, the corresponding switching circuit as shown in FIGS. 8, 9, or 10 conducts so as to ground the point K, i.e., the one terminal of the corresponding first capacitor $C_1$. Therefore, the voltage at the point Q is rapidly changed from zero to minus DC voltage, i.e., −1000 volts. This rapid change in voltage is applied to the corresponding voltage boosting transformer $T_1$ through the conducted corresponding switching circuit, since the corresponding second diode $D_2$ is inconductive with respect to the ground. The primary winding $L_p$ of the corresponding transformer T and a second capacitor $C_2$ thus constitute an damped oscillation circuit ($C_1 > C_2$) at which a damped oscillation having a frequency expressed as $f_1 \doteqdot \frac{1}{2\pi\sqrt{L_p C_2}}$ occurs. Thus the damped oscillation AC voltage having a frequency of $f_1$ and having a maximum amplitude of 1 KV is produced at the primary winding $L_p$ of the corresponding voltage boosting transformer T. Furthermore, the boosted high voltage N KV determined by the winding ratio N:1 between the secondary winding $L_s$ and primary winding $L_p$ of the transformer T is applied immediately to the corresponding plasma ignition plug $P_1$ through $P_4$ so that the corresponding plug $P_1$ through $P_4$ sparks at a time $T_B$ shown in FIG. 4 and the electrical breakdown occurs at the discharge gap 4 as described with reference to FIG. 1. Thus the corresponding plasma ignition plug $P_1$ through $P_4$ is in a conductive state. Immediately after the corresponding plug $P_1$ through $P_4$ is in the conductive state, a glow discharge caused by the damping oscillation voltage of the primary winding $L_p$ of the corresponding transformer T and second capacitor $C_2$ occurs at a time interval between $T_B$ and $T_C$ shown in FIG. 4. Thereafter, an arc discharge occurs according to the energy remaining in the first capacitor $C_1$ (about 0.4 joules) corresponding to 80% of the maximum charged energy within the first capacitor $C_1$ after the time $T_c$ as shown in FIG. 4. The electric current Is1 flowing through the corresponding plug $P_1$ through $P_4$ is shown in FIG. 4.

Figure 5:
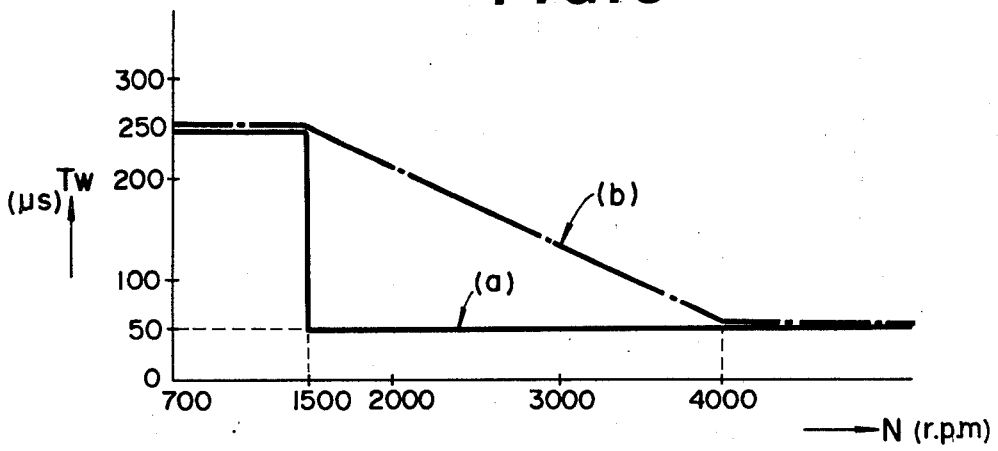
FIG. 5 is a characteristic graph showing two modes of changes in the pulse width of a third pulse signal e produced from a control circuit shown in FIG. 2(B)

In the plasma ignition system according to the present invention, if the pulsewidth $T_W$ of the output signal e produced from the control circuit E is reduced stepwise from, e.g., 250 microseconds to 50 microseconds when the engine speed is increased and exceeds the predetermined number of revolutions per time, e.g., 1,500 rpm as shown in FIG. 5, the conducting time interval within which the corresponding switching circuit is in a conductive state becomes substantially 50 microseconds. Therefore, e.g., one of the ignition plugs $P_1$ through $P_4$ produces the spark discharge and part of glow discharge and thereafter the energy discharging operation of the corresponding first capacitor $C_1$ halts. Consequently, the corresponding plasma ignition plug $P_1$ through $P_4$ only ignites the air-fuel mixture by the sparking action not perform the discharge of the plasma gas.

Conversely in a region where the number of engine revolutions per time is below 1,500 rpm, the conducting time interval of the corresponding switching circuit is 250 microseconds as shown in FIG. 5. Therefore a sufficient arc discharge time ($T_C \rightarrow T_D$ as shown in FIG. 4) can be obtained so that the high voltage energy charged within the corresponding first capacitor $C_1$ is substantially discharged to perform a complete plasma ignition.

In the case described above where the pulsewidth of the output pulse signal e produced from the control circuit E is changed stepwise at a boundary engine speed of 1,500 rpm as shown by (a) of FIG. 5, the ignition energy $E_s$ at each ignition timing of engine in the case when the engine speed exceeds 1,500 rpm is reduced abruptly to about ten percents (10%) of that (about 0.5 joules) in the case when the engine speed is below 1,500 rpm, as shown by (a) of FIG. 6. On the other hand, the consumed current I drops abruptly when the engine speed arrives at 1,500 rpm and increases gradually as the engine speed increases more than 1,500 rpm, as shown by (a) of FIG. 7.

Figure 6:
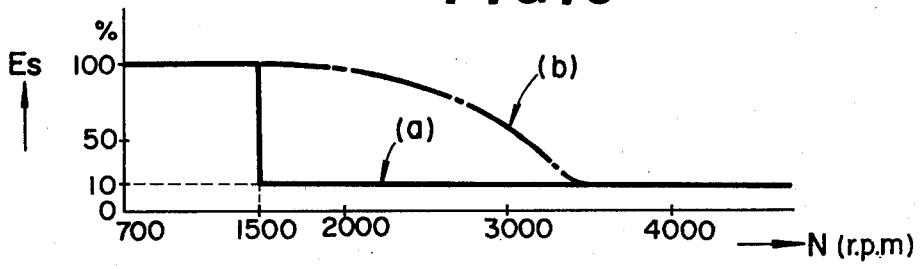
FIG. 6 is a characteristic graph showing a plasma ignition energy $E_s$ applied across each plasma ignition plug when the width of third pulse signal e is changed as shown in FIG. 5.
Figure 7:
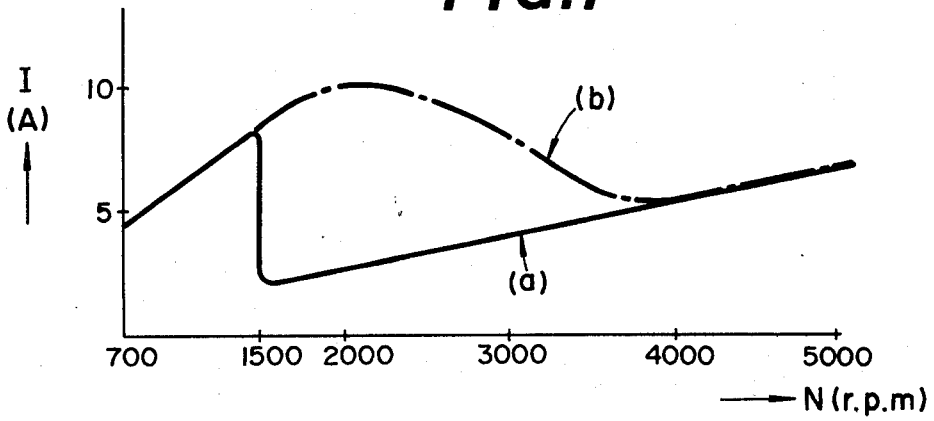
FIG. 7 is a characteristic graph showing changes in the consumed current flowing through each plasma ignition plug when the width of the third pulse signal e is changed as showin in FIG. 5.

Next if the pulse width $T_w$ of the output pulse signal e from the control circuit E is decreased linearly as shown by (b) of FIG. 5 when the engine speed increases and exceeds 1,500 rpm, the time interval at which an arc discharge is carried out is shortened gradually as the pulse width $T_w$ decreases, so that the ignition energy $E_s$ for each plasma ignition plug $P_1$ through $P_4$ corresponds to the total amount of the current I's1 flowing through each corresponding plasma ignition plug $P_1$ through $P_4$ and decreases gradually as the engine speed increases and exceeds 1,500 rpm as shown by (b) of FIG. 6. In this case, the consumed current I increases until the engine speed increases and arrives at about 2,000 rpm, as shown by (b) of FIG. 7. After the engine speed increases and exceeds about 2,000 rpm, the consumed current I decreases slowly as shown by (b) of FIG. 7.

In the preferred embodiment described above, an optimum plasma ignition can be achieved since the plasma ignition energy Es is reduced in a high-speed engine operating condition.

Figure 2C:
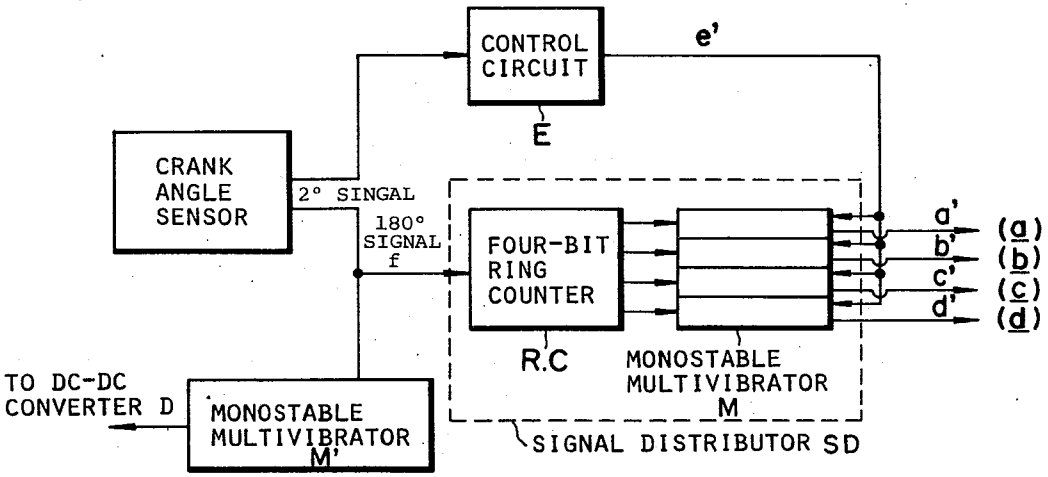
FIG. 2(C) shows an alternative of the plasma ignition system in combination with the circuit shown in FIG. 2(A)

FIG. 2(C) is another preferred embodiment of the present invention in combination with the circuit shown in FIG. 2(A).

In the circuit shown in FIG. 2(C), the control circuit E outputs a signal e' on a basis of the determined engine speed detected from the crank angle sensor and each monostable multivibrator M outputs the trigger pulse signal a', b', c', and d' having the width being varied according to the output signal e' from the control circuit E. Each trigger pulse signal is fed into each corresponding switching circuit as in the same way described with reference to FIGS. 2(A) and 2(B). The width of each trigger pulse signal a', b', c', and d' from each corresponding multivibrator M is 250 microseconds when the engine speed is below 1,500 rpm as shown in FIG. 5. The width of each trigger pulse signal a', b', c', and d' is changed in such a mode as shown by (a) or (b) of FIG. 5 when the engine speed exceeds 1,500 rpm. The output signal e' from the control circuit E shown in FIG. 2(C) serves to modify the width of the output trigger pulse signal from each monostable multivibrator as shown in FIG. 5. That is to say, the output signal e' is fed into an output pulse width determining means, e.g., capacitor and resistor of each monostable multivibrator M so that each output pulse width $T_W$ is changed as shown in FIG. 5. In this case, such a capacitor or resistor may preferably be voltage-variable element in the change mode of (b) in FIG. 5. In the case shown by (a) of FIG. 5, such a capacitor or resistor may preferably be an additional capacitor or resistor connected to the capacitor or resistor via a drive switch, wherein the output signal e' causes the drive switch to close so that the additional capacitor or resistor is connected parallel to the capacitor or resistor. Thus, each output pulse-width $T_W$ is changed stepwise.

It should be noted that, as shown in FIGS. 2(B) and 2(C), another monostable multivibrator M' is provided between a halt terminal of the DC-DC converter D and crank angle sensor for temporarily halting the oscillation action of the DC-DC converter D in a given interval of time after each of the first capacitors $C_1$ charges completely the high DC voltage from the DC-DC converter D when the 180° pulse signal is received thereinto from the crank angle sensor, so that the power consumption of the battery B can be saved considerably.

It should also be noted that the plasma ignition system according to the present invention can be applied to an internal combustion engine having any number of engine cylinders.

As described hereinbefore, an engine plasma ignition system according to the present invention which varies the conducting time interval of each switching circuit for controlling the current flow therethrough from the corresponding first capacitor into the corresponding plasma ignition plug according to the engine speed so as to provide a complete plasma ignition until the arc discharge only when the engine rotates within a low speed region where the combustion becomes easily unstable and to provide a spark discharge and part of glow discharge when the engine rotates within a higher speed region where the combustion becomes stable, so that a minimum amount of the ignition energy required for igniting the air-fuel mixture and for achieving a stable combustion can be supplied to each plasma ignition plug and accordingly the total consumed current flowing through the plugs can be reduced considerably.

What is claimed is:

1. A plasma ignition system for an internal combustion engine having a plurality of engine cylinders, comprising:

(a) a plurality of plasma ignition plugs each provided within the corresponding cylinder for igniting fuel supplied into the corresponding cylinder, said each plasma ignition plug having a grounded side electrode and central electrode, an electrical insulating member located between the two electrodes, and a discharge gap with a hole provided between the two electrodes so as to carry out plasma discharge;

(b) a DC-DC converter which generates and outputs a high DC voltage;

(c) a plurality of first capacitors connected to said DC-DC converter, each for charging and discharging the high DC voltage outputted from said DC-DC converter;

(d) a plurality of switching circuits, each connected to one terminal of said corresponding first capacitor and which grounds the one terminal of said corresponding first capacitor in which the high DC voltage from said DC-DC converter is fully charged with the other terminal of said corresponding first capacitor in a floating state, in response to a trigger pulse signal received at a drive terminal thereof, said trigger pulse signal controlling the time interval within which said corresponding first capacitor is grounded so as to feed the plasma ignition energy charged therewithin into said corresponding plasma ignition plug according to the pulsewidth thereof;

(e) a plurality of transformers, each common terminal of both primary and secondary windings thereof being connected to the other terminal of said corresponding first capacitor and each other terminal of the secondary winding thereof being connected to the central electrode of said corresponding plasma ignition plug and each of which boosts the voltage applied to the primary winding thereof at the corresponding secondary winding thereof to a voltage level enough for the corresponding plug to generate a spark discharge according to the winding ratio therebetween immediately after said corresponding switching circuit grounds the one terminal of said corresponding first capacitor;

(f) a plurality of second capacitors each connected between the other terminal of the primary winding of said corresponding transformer and ground, each of said second capacitor and corresponding primary winding constituting a damped oscillation circuit so as to provide a damped oscillation for said corresponding plug to generate a glow discharge subsequent to the spark discharge responsive to the high DC voltage applied thereto through said corresponding switching circuit from said corresponsing first capacitor; and (g) a trigger pulse signal generator which generates and outputs circularly said trigger pulse signal into each of drive terminals of said switching circuits according to the ignition order of the engine cylinders, the width of said trigger pulse signal becoming narrower when the engine rotates at a speed exceeding a first predetermined value than a first predetermined width of said trigger pulse signal having a time interval enough for said corresponding plasma ignition plug to generate an arc discharge subsequent to the glow discharge.

2. A plasma ignition system as set forth in claim 1, wherein said trigger pulse signal generator comprises:

(a) a sensor for outputting a first pulse whenever the engine rotates through a first predetermined angle, the first predetermined angle being determined according to the number of engine cylinders, and outputting a second pulse in synchronization with the first pulse whenever the engine rotates through a second predetermined angle, the second predetermined angle being a basis for detecting the engine speed;

(b) a control circuit, connected to said sensor for detecting the engine speed on a basis of the number of said second pulses per time inputted thereto and outputting a third pulse signal, the width of said third pulse signal being changed according to the detected engine speed so as to become narrower than the first predetermined width when the engine rotates at a speed higher than the first predetermined value;

(c) a pulse signal distributing circuit, connected to said sensor, which produces and circularly distributes a fourth pulse signal whenever the first pulse is received from said sensor;

(d) a plurality of monostable multivibrators, each outputting a fifth pulse signal having a second predetermined width in response to the fourth pulse signal from said pulse signal distributing circuit, the width of said fifth pulse being longer than that of said third pulse; and (e) at least one AND gate circuit, connected between each of said monostable multivibrators and said control circuit, for ANDing the third pulse signal from said control circuit and the fourth pulse signal from said corresponding monostable multivibrator to send the ANDed trigger pulse signal to the drive terminal of said corresponding switching circuit.

3. A plasma ignition system as set forth in claim 1, wherein each of said switching circuits comprises a DC bias voltage supply and two transistors in darlington connection, a base of the first transistor being connected to the output terminal of said trigger pulse signal generator, said DC voltage supply applied to a collector thereof, an emitter thereof being connected to a base of the second transistor, a collector thereof being connected to the one terminal of said corresponding first capacitor, and an emitter thereof being grounded.

4. A plasma ignition system as set forth in claim 1, wherein each of said switching circuits comprises:

(a) a minus DC bias voltage supply;

(b) an inverter connected to the output terminal of said trigger pulse signal generator;

(c) a third capacitor connected to said inverter;

(d) a first resistor connected between said third capacitor and ground, said third capacitor and first resistor constituting a differentiator for producing a negative going pulse whose width depends on the time constant determined by said third capacitor and first resistor in response each rise of the trigger pulse signal from said trigger pulse signal generator;

(e) a third transistor, a base connected to said third capacitor constituting the differentiator, an emitter thereof grounded and said minus DC voltage applied to a collector thereof; and (f) a first Field Effect Transistor of N channel type, a drain thereof being connected to the one terminal of said corresponding first capacitor, a source thereof being grounded, and a gate thereof being connected to the collector of said third transistor.

5. A plasma ignition system as set forth in claim 1, wherein each of said switchingcircuits comprises:

(a) a plus DC bias voltage supply;

(b) a fourth capacitor connected to said trigger pulse signal generator;

(c) a second resistor connected to said fourth capacitor, said second resistor and fourth capacitor constituting a differentiator for producing a positive going pulse whose width depends on the time constant determined by said fourth capacitor and second resistor in response each rise of the trigger pulse signal from said trigger pulse signal generator;

(d) a fourth transistor, a base thereof connected to said fourth capacitor, an emitter thereof grounded and a plus DC bias voltage applied to a collector thereof; and (e) a second Field Effect Transistor of P channel type, a source thereof being connected to the one terminal of said corresponding first capacitor, a drain thereof being grounded, and a gate thereof being connected to the collector of said third transistor.

6. A plasma ignition system as set forth in claim 2, wherein said control circuit outputs the third pulse signal having a third predetermined pulsewidth when the engine rotates at a speed higher than the first predetermined value, the third predetermined width being shorter than the first predetermined width.

7. A plasma ignition system as set forth in claim 2, wherein said control circuit outputs the third pulse signal whose width is the first predetermined width until the engine rotates at a speed lower than the first predetermined value and becomes narrower gradually as the engine speed increase more than the first predetermined value until a second predetermined value of engine speed is reached.

8. A plasma ignition system as set forth in any one of claims 1, 2, 6, and 7, wherein the first predetermined value of the engine speed is 1500 rpm.

9. A plasma ignition system as set forth in any one of claims 2, 6, and 7, wherein said first predetermined pulsewidth is 250 microsecond and said second predetermined pulsewidth is 500 microseconds.

10. A plasma ignition system as set forth in claim 6, wherein said third predetermined pulsewidth is 50 microseconds.

11. A plasma ignition system as set forth in claim 2, wherein said pulse signal distributing circuit is a multi-bit ring counter, the bit number of said multi-bit ring counter being determined by the number of engine cylinders.

* * * * *